United States Patent [19]

Orban

[11] 4,287,453

[45] Sep. 1, 1981

[54] ELECTRONIC SLAVE FLASH DELAY DEVICE

[75] Inventor: Jean M. Orban, Santa Monica, Calif.

[73] Assignee: Vivitar Corporation, Santa Monica, Calif.

[21] Appl. No.: 72,896

[22] Filed: Sep. 6, 1979

[51] Int. Cl.[3] ..... H05B 41/34

[52] U.S. Cl. ..... 315/159; 250/214 SF; 315/151; 315/152; 315/155

[58] Field of Search ..... 315/151, 154, 156, 159, 315/241 P; 250/214 P, 214 SF; 354/33, 131; 315/152, 155

[56] References Cited

U.S. PATENT DOCUMENTS

| | | | |
|---|---|---|---|
| 3,601,652 | 8/1971 | Burnett | 250/214 P |
| 3,636,406 | 1/1972 | Ackermann | 250/214 SF |
| 3,944,877 | 3/1976 | Sato | 315/241 P |

*Primary Examiner*—Eugene R. La Roche
*Attorney, Agent, or Firm*—Lyon & Lyon

[57] ABSTRACT

A device for activating an electronic slave flash unit for photographic use includes a circuit wherein there is a delay circuit responsive to a light sensing signal after a predetermined time delay to activate a flash unit. The time delay of the delay circuit is adjustable as required, and the delayed operation of the flash of the slave flash unit eliminates incorrect impulse signals being transmitted to light sensors of other slave flash units which would otherwise prematurely extinguish their flash and give a resultant incorrect lighting effect. The power for the circuit is obtained from a capacitor which is energized by a flash unit. The energy in the capacitor is used to power the delay circuit, and a Zener diode and unijunction transistor and variable resistance permit accurate variable time delays.

33 Claims, 8 Drawing Figures

ELECTRONIC SLAVE FLASH DELAY DEVICE

DESCRIPTION

This invention relates to photographic apparatus. In particular, the invention is directed to slave flash units, and devices for triggering slave flash units.

A slave flash unit is a device which is used in conjunction with a master flash unit to provide fill-in or background lighting in photography. The slave flash units are located at different points and provide light as required for the photograph. The slave flash is related to the main flash so that requisite lighting ratios are achieved for optimum lighting effect such as key, fill, highlight and background lighting. A master flash unit is a unit which is directly operated by a camera, and on shutter activation, the master unit fires its flash and conventionally slave units operate simultaneously. The slave units are, conventionally, either connected to the master unit by wires or have electronic light sensor means which respond to light from the master flash such that their operation is triggered.

In the operation of an electronic flash unit, the activation of the camera shutter triggers the flash, causing light to be generated. If the flash is of the automatic type, extinction of the flash can occur after a predetermined amount of light is reflected from the scene being photographed and detected by a sensor associated with the flash.

However, when an automatic flash is used in a master-slave arrangement, difficulties are encountered. More particularly, when the master flash unit and slave flash units flash, light from some or all of the slave flash units may be received at the sensor of the master flash unit. This means that excessive light is received at the master unit causing the master flash unit to extinguish too quickly and resulting in an improperly exposed subject. If the slave flash units are also of the automatic type, similar difficulties may be encountered which cause the slaves to extinguish prematurely, thereby upsetting the desired lighting ratios between the master and slave units. Thus it has been conventional to require that flash units be operated in a manual mode if used in a master-slave arrangement.

Although various arrangements for master-slave flash units are known in the art, none have solved the difficulties discussed above. More particularly, there exists U.S. Pat. No. 3,590,314 which is directed to electronic flash lamp apparatus, using a plurality of electronic flash tubes fired in quick succession and having a photo responsive circuit which stops the firing sequence when light produced by the tubes reaches a cumulative total sufficient for the intended purpose, thereby saving stored energy for subsequent firing operations. U.S. Pat. No. 2,776,364 discloses a means of concentrating the light for a slave unit such as to make the slave unit responsive to operation at greater distances. In U.S. Pat. No. 3,487,221 there is disclosed a light activated triggering device which has an extremely fast response time for a slow flash unit. U.S. Pat. No. 3,288,044 discloses a trigger circuit for generating a high voltage trigger pulse for slave flash tubes which fire simultaneously. In U.S. Pat. No. 3,196,275 the disclosure is of a circuit which operates at great speed with no time-consuming elements such that the slave unit can operate effectively on triggering by light from an incandescent flash bulb of the camera. U.S. Pat. No. 2,486,010 discloses an arrangement for reducing the time delay between a master control and the ignition of a flash bulb to the order of microseconds so that synchronization problems are minimized, such problems being caused by voltage drops which increase the heating time of a fuse or element within the flash bulb, such fuse being melted by the heat of a firing current passing through. Other prior art of general interest relating to slave flash units are U.S. Pat. Nos. 3,312,086 and 3,917,944, which relate respectively to a slave flash unit carrying a plurality of bulbs which are brought one at a time into readiness for firing, and an accessory for a slave device having a light sensor and a rotatable hot shoe allowing the electronic flash to be aimed as desired.

The present invention includes means for permitting a plurality of automatic flashes to be used in a master-slave arrangement by delaying the triggering of each successive slave unit until after each preceding flash has been extinguished.

More particularly, according to the present invention there is a device for activating an electronic slave flash unit which includes a circuit wherein there is a delay circuit responsive to a light sensing signal after a predetermined time delay to activate a flash unit.

In a preferred form of the invention, the flash unit includes light sensing means which are responsive to a light impulse to generate a signal. A switch which is responsive to such signal transmits in turn a trigger signal to a delay circuit which is operative after a prerequisite time delay to transmit a switching signal to activate the flash unit.

Preferably, the time delay is determined by the delay circuit itself which includes a unijunction transistor and a bank of different resistors or a variable resistance, the particular resistance being chosen by the user to determine the appropriate time delay.

A capacitor with a stored charge preferably provides the energy for powering the circuit, and the trigger signal is the outflow of power stored in the capacitor circuit. This power is placed across a capacitor for the delay circuit and a Zener diode regulates the power such that the voltage to the delay circuit is maintained constant.

Figure 1:
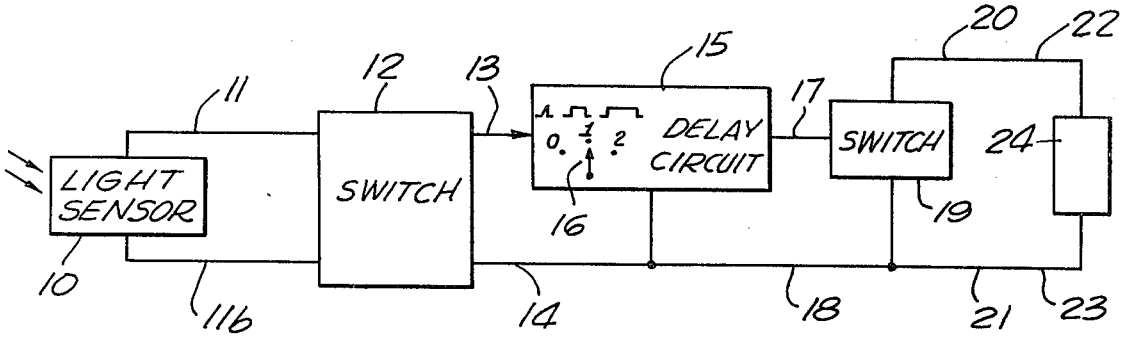
FIG. 1 is a schematic block diagram of a circuit in accordance with the invention.

Referring to FIG. 1 of the drawings, a light sensor indicated by numeral 10 detects light impulses from a master flash which may or may not be a flash directly associated with the camera. The light sensing means 10 generates a signal which is fed by leads 11 and **11*b* to a switch unit 12 which in turn operates via leads 13 and 14 a time delay circuit means 15. The circuit 15 is illustrated as having a switch 16 which can be set to one of three settings indicated by numerals 0, 1 and 2, each having a graphic representation showing different time delays. The delay circuit 15, after the prerequisite delay, fires a switch 19 through leads 17 and 18. The closure of the switch 20 closes the circuit through terminals 22 and 23 and thereby places the trigger voltage across the flash unit 24**, which fires.

Figure 2:
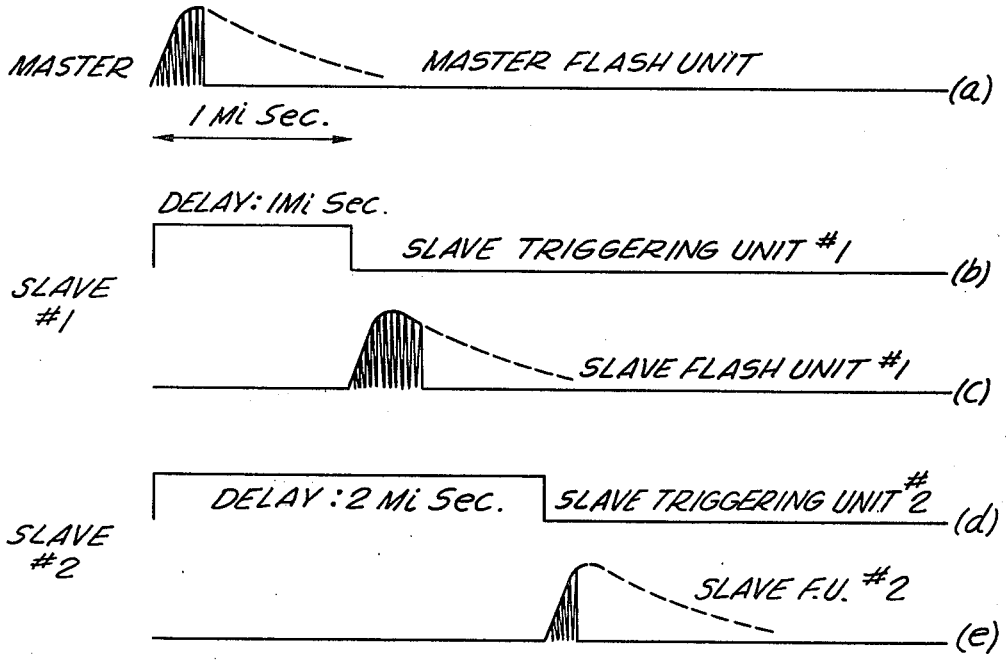
FIG. 2 is a graphic representation of the time sequences of a master flash unit and two slave triggering units.

In reference to FIG. 2, the first graphic representation being line (a) depicts the light pulse from the master flash unit which may, for example, have an overall effective duration on the order of one millisecond. The pulse is effectively shown as occupying the space of about 0.25 milliseconds. Graphic representation line (b) depicts the time delay of one millisecond and read with graphic representation of line (c) indicates when the first slave unit would be synchronized to operate, namely, after about one millisecond delay. The flash duration of the slave unit #1 would be, also as depicted, about 0.35 milliseconds. Graphic representation line (d) represents a two millisecond delay effective for a second slave triggering unit and read with line (e) depicts the operation of the second slave flash unit as commencing operation after a two millisecond delay from initiation of the flash by the master flash unit. The flash duration of slave unit #2 is shown in the order of 0.1 millisecond.

Between commencement of the flash of the master flash unit and finalization of the flash of the second slave unit, a time not far greater than two milliseconds has endured which is well within the operating times of a camera shutter speed. A 1/30th second shutter speed is representative of 33 milliseconds, a 1/60th second shutter speed 16 milliseconds, and a 1/125th second shutter speed would represent 8 milliseconds. In this fashion, therefore, the various flashes will each take place sequentially while the shutter is open. At the same time, no interference of the flashes from the various flash units occurs, one to the other, so that the flashes of the different flash units will not be sensed by the light sensors of other flash units. In this fashion, the proper amount of light reaches the subject from each flash without premature extinction of any flash due to interference from one or another of the units.

The detailed schematic operation of FIG. 3 will now be described. The exemplary circuit for an electronic slave flash unit employs as a light sensing means a photodiode stack 25, the light rays being indicated by arrows 26. Connected across the photodiode stack is a resistor 27 which improves the speed response characteristics of the photodiode 25. The output from the photodiode 25 is connected to a capacitor 28 which acts to filter out any steady-state signal that results when ambient light 26 impinges on the diode 25, thereby permitting only impulse light from the flash to pass to an amplifier stage **29*a*** of the circuit, described immediately hereinafter.

The amplifier stage **29*a* includes a transistor 29 together with appropriate biasing circuitry in the form of a biasing resistor 30, a loading resistor 31, and another pair of biasing resistors 58 and 59. The resistors 58 and 59 form a voltage divider, with the collector of the transistor 29 being connected at the junction thereof. The remaining terminal of the resistor 59 is connected to the positive terminal 53 of the trigger line of an associated flash (not shown) via a conventional connector 55, while the remaining terminal of the resistor 58 is connected to the reference side 54 of the connector 55. A capacitor 73** provides suitable decoupling.

The biasing resistor 30, which may for example have a value of one megohm, provides bias to the base of the transistor 29 and also ensures a relatively low current through the amplifier stage **29*a*. The load resistor 31, nominally one kilohm, biases the gate of a thyristor 32 and sets the level of light incident on the detector 25 which is necessary to trigger the thyristor 32, thereby ensuring that the thyristor 32** does not fire prematurely.

The thyristor 32 responds to a gating signal provided from the amplifier stage **29*a* by connecting a charged capacitor 33 to a delay circuit indicated generally at 33*a* through a resistor 34, thereby energizing the delay circuit 33*a*. Energy is supplied to the capacitor 33 from the flash unit via the terminal 53 and a resistor 57, which sets the charging rate of the capacitor 33**. A suitable time constant for such charging may be on the order of two seconds.

Once the thyristor 32 has been triggered, the discharge current supplied by the capacitor 33 charges another capacitor 35 until a voltage set by a zener diode 36 is reached. For the exemplary circuit shown in FIG. 3, the zener diode 36 may avalanche at twenty-five volts. The resistor 34 mentioned above limits the current supplied to the zener 36, thereby preventing overloading, and also regulates the discharge rate of the capacitor 33.

Figure 5:
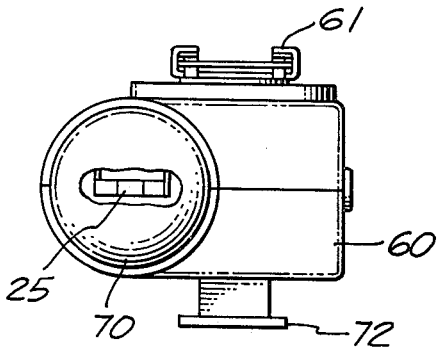
FIG. 5 is a front elevation view of the slave flash unit, with part of the front broken away.
Figure 6:
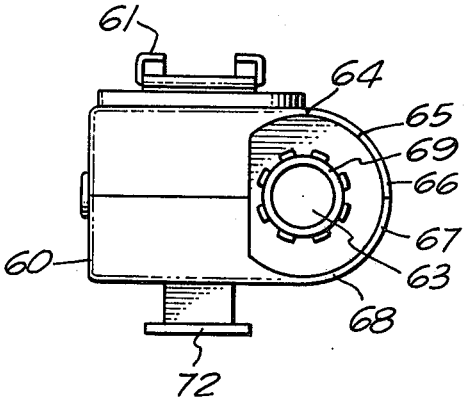
FIG. 6 is a rear elevation view of the unit.
Figure 7:
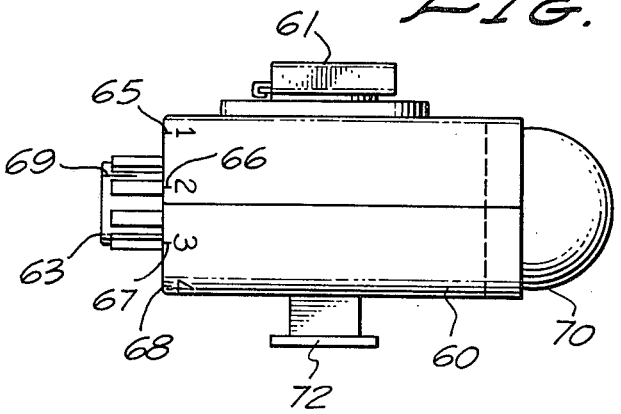
FIG. 7 is a side elevation view of the unit.

The delay circuit **33*a* which is energized from the capacitor 33 includes a unijunction transistor 37 and associated biasing resistors 38 and 40, together with a capacitor 43, a plurality of selectable resistors 45–49, and a selection switch 50. More particularly, the gate of the unijunction transistor 37 is connected to the junction of the resistors 38 and 40, with the remaining terminal of the resistor 38 being connected to the output of the thyristor 32 and the remaining terminal of the resistor 40 being connected to the reference side 54 of the connector 55. The capacitor 43 is connected to a selected one of the resistors 45–49 through the switch 50, while the gate of the unijunction transistor 37 is connected to the junction of the capacitor 43 and switch 50. The switch 50 may be of the rotary type as will be better appreciated in connected with FIG. 5**.

The values of the resistors 45–49 are preferably varied over a substantial range to provide, in connection with the remainder of the delay circuit **33*a* and particularly the capacitor 43, a plurality of delay characteristics for the delay circuit 33*a*. Exemplary resistive values are on the order of 1.5, 15, 30, 40 and 62 kilohms, with the capacitor 43** having a nominal value on the order of 0.0047 microfarads. Those skilled in the art will recognize that a wide variety of resistor and capacitor values may be utilized to provide the desired results.

The cathode of the unijunction transistor 37 is connected to the gate of another thyristor 52, the remaining terminals of which are connected across the terminals 53 and 54 of the connector 55. The thyristor 52, once activated, can thus be seen to trigger the flash unit connected at the connector 55. A resistor 56 is connected between the gate of the thyristor 52 and the reference terminal 55, and loads the transistor 37 while at the same time biasing the thyristor 52 to ensure against premature triggering and shutdown.

In operation of the circuit, ambient and impulse light rays 26 impinge upon the photodiode 25 and by means of the capacitor 28, only impulse light rays 26 pass through to be amplified by the amplifier stage **29*a*. The thyristor switch 32 is operated by a signal from the amplifier 29, and causes prestored energy in capacitor 33 to pass as a trigger signal, thereby charging the capacitor 35 and placing a voltage on line 39 as regulated by the zener diode 36. The energy stored in capacitor 35 discharges through the delay circuit 33***a* constituted by unijunction transistor 37, resistors 38, 40, capacitor 43 and one of the resistors 45–49 as chosen to provide a predetermined time delay. After this time delay, a signal passes through the cathode terminal 51 to the main switching thyristor 52. This signal acts to gate the switching thyristor 52 which causes the flash unit to be fired by shorting the contacts 53 and 54 therethrough, and also permits the capacitor 33 to discharge.

Typically, the delay circuit with the bank of resistors 45–49 can be designed for a delay between zero and about 10 milliseconds, depending on the value of the particular resistor coupled into circuit. Conventional camera shutter speeds, for flash synchronization, operate between eight milliseconds (shutter speed 125) and thirty-three milliseconds (shutter speed 30). Thus, by arranging delay circuits to operate at any one of the chosen delay intervals, a suitable sequence of flashes can be set up within the shutter open time and wherein interference of one flash to another and premature extinction of flashes are avoided.

In FIGS. 4, 5, 6 and 7 an embodiment wherein the electronic slave flash circuitry can be housed is illustrated, and this is shown as a casing 60 on which is mounted a shoe 61 for a flash unit (not shown). The electrical contact for the flash unit is indicated by the numeral 62. A rotary switch 63 is indicated at the rear end of the casing and alignment of the indicators 64, 65, 66, 67 or 68 on the casing body 60 with markings 69 on the rotary switch 63. This will correspond to setting the delay circuit with one of the chosen resistors 45–49 in the circuit by means of the switch 50. On the forward end of the casing there is a shade 70 within which is housed the photodiode 25. The device itself can be suitably mounted through a foot 72 on a support tripod or the like. The powering arrangement of the delay circuit through the zener diode 36 and storage capacitor 33 creates an accuracy which is sufficient to ensure timely operation of the delay circuit and this is important in view of the precise timing sequences which are necessary in order to achieve effectively the object of the invention. In place of the electrical contact through terminal 62, a flash may be connected by cable to the contact pin 71 in the side wall of the casing 60.

Figure 8:
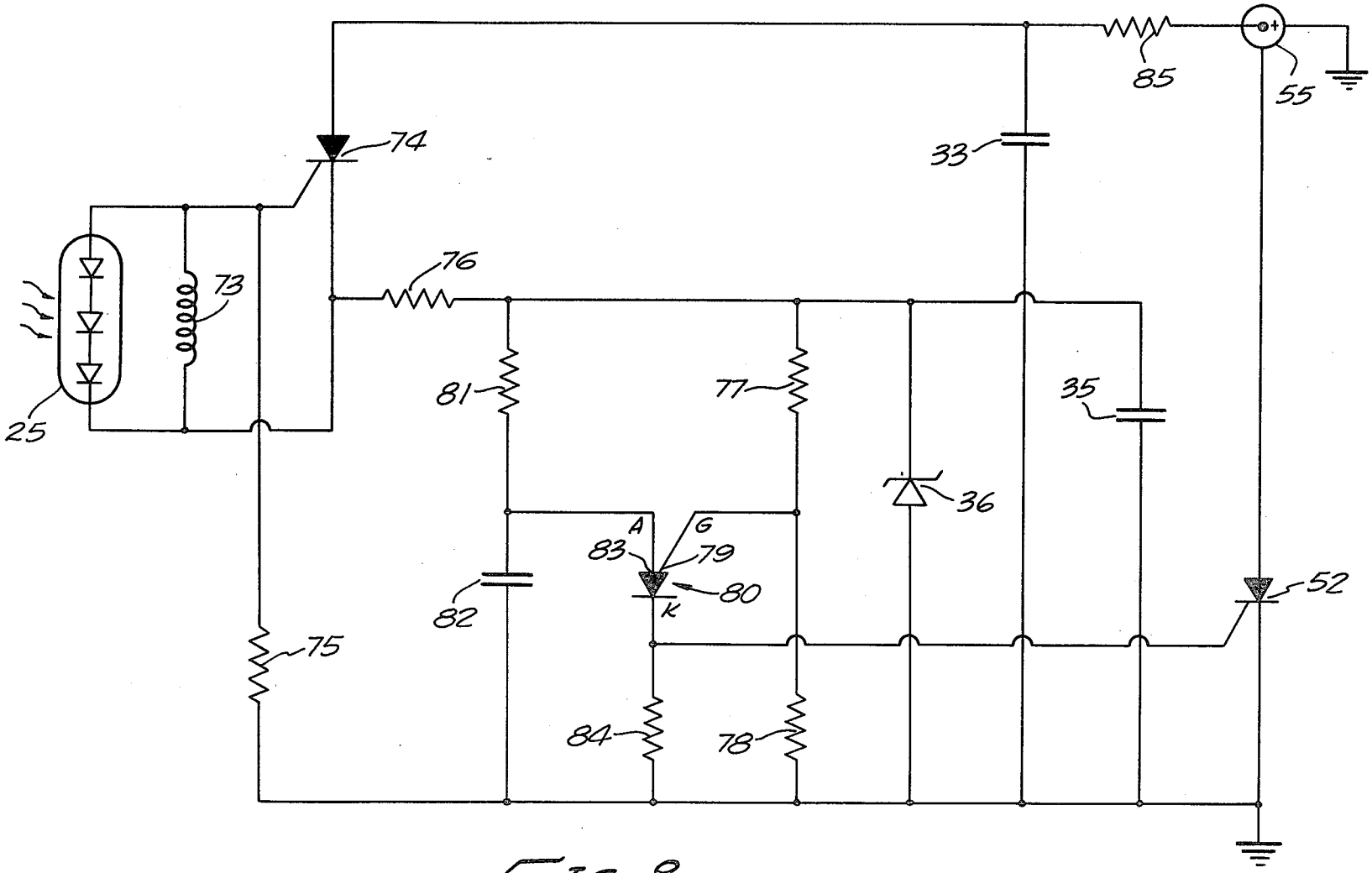
FIG. 8 is a schematic of a different circuit embodiment of a slave flash unit with a delay circuit.

In the embodiment of the invention illustrated in FIG. 8, the photodiodes 25 receive the flash impulse and ambient light is filtered out by choke 73 such that the impulse from the flash will pass to SCR 74. Resistor 75 acts as a filter to ensure against false triggering of the gate of SCR 74. Power is supplied from the flash unit (not shown) through contacts 55 and in turn is stored on capacitor 33. The central terminal will be about 200 volts positive. Resistor 85 permits the energy from terminal 55 to charge the capacitor 33 up to the requisite level for the circuit. Triggering the SCR 74 permits discharge of energy from capacitor 33 and through resistor 76 thereby causing capacitor 35 to become charged.

Zener diode 36 causes the level of the voltage across capacitor 35 to be clamped in this example to 25 volts. This voltage is divided by resistors 77 and 78 which are across the gate terminal 79 of a programmable unijunction transistor (PUT) 80. Resistor 78 is variable thereby permitting variation of the threshold level of PUT 80 by changing the voltage point on gate 79. Resistor 81 charges capacitor 82 which has connected between them the anode terminal 83 of the PUT 80, and when the voltage on anode 83 exceeds the voltage on gate terminal 79, the PUT 80 fires. This causes voltage drop across resistor 84 which triggers SCR 52 and in turn causes the flash to operate in the manner described above with regard to the circuit of FIG. 3.

Variation of resistance 78 between a value of 47 kohms and 15 mohms varies the time delay between 0.75 msec and 50 msec. Changing the capacitor 82 can also cause variation of the time delay of the circuit.

Figure 3:
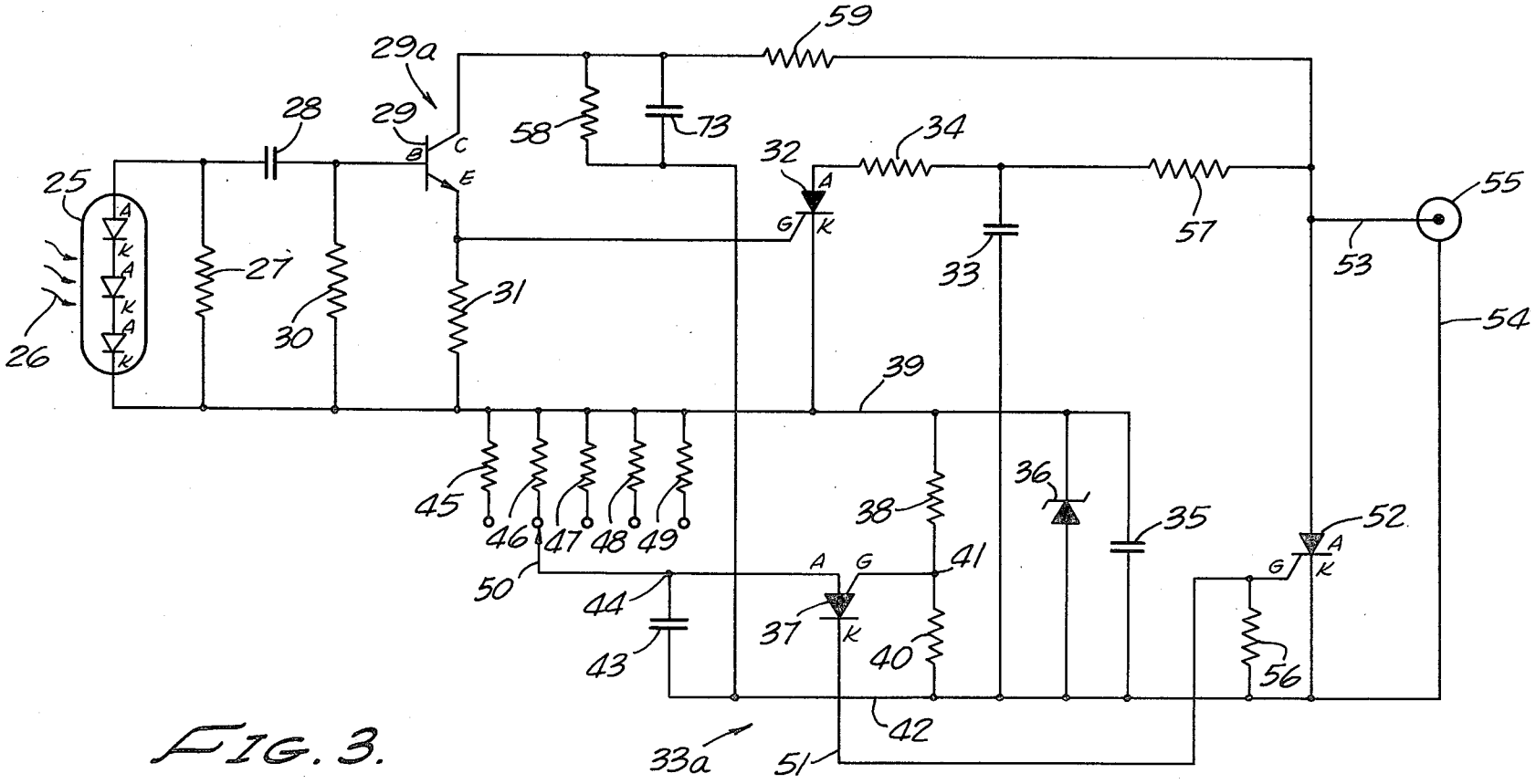
FIG. 3 is a schematic of a circuit of a slave flash unit with a delay circuit.
Figure 4:
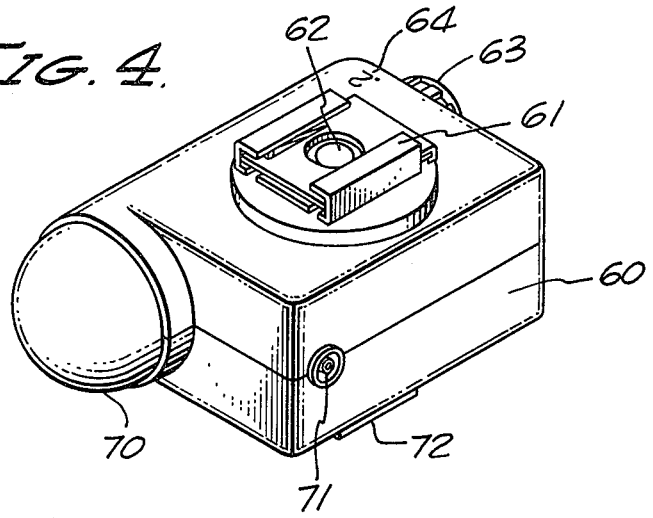
FIG. 4 is a perspective representation of one embodiment of a slave flash unit in accordance with the invention.

This circuit can also be accommodated in a housing in similar form to the manner described above with reference to the circuit illustrated in FIG. 3.

Although the invention has been described with reference to an automatic flash operation it is possible to have the flash units operate in a manual fashion. This would be, for instance, in strobe photography where individual units are set for different time delay sequences, whereby each flash provides a different exposure during the single shutter opening.

While embodiments and applications have been shown and described, it will be apparent to those skilled in the art that many more modifications are possible without departing from the inventive concepts herein described, and as fall within the scope of the appended claims.

I claim:

1. A device for activating an electronic slave flash unit including in a circuit light sensing means adapted to be responsive to a light impulse from a master flash unit to thereby generate a first signal;

delay circuit means including control means for providing different time delays, said delay circuit means being responsive to said first signal and operative, after a predetermined selected time delay, to generate a switching signal; and switching means responsive to the switching signal and adapted to activate the associated flash unit.

2. The device as claimed in claim 1 including switch means between the light sensing means and the delay circuit, the switch means being responsive to the first signal to transmit a trigger signal to the delay circuit means.

3. The device as claimed in claim 2 including an energy storage capacitor for powering the circuit, the trigger signal permitting power from the capacitor to discharge through the delay circuit, and such discharge powering the delay circuit to transmit the switching signal after the predetermined time delay.

4. The device as claimed in claim 3 wherein the delay circuit includes a capacitor and a zener diode, such capacitor being charged by the capacitor for the circuit and such diode ensuring a regulated voltage supply from the delay circuit capacitor across the delay circuit.

5. The device as claimed in either claim 1 or claim 3 wherein the delay circuit includes a unijunction transistor and the control means includes a variable resistance, the resistance value determining the time delay of the time delay circuit.

6. The device as claimed in claim 5 wherein the unijunction transistor is a programmable unijunction transistor.

7. The device as claimed in claim 6 wherein the time delay is selected to be at least substantially the flash duration of the light impulse from the master flash unit.

8. The device as claimed in any one of claims 1, 2 or 3 wherein the time delay is selected to be at least substantially the flash duration of the light impulse from the master flash unit.

9. A device for activating an automatic electronic flash unit including in a circuit light sensing means adapted to be responsive to a light impulse from a master flash unit and thereby generate a signal, such light sensing means including an amplifier;

switch means responsive to the signal from the amplifier to transmit a trigger signal;

delay circuit means including control means for providing different time delays, said delay circuit means being responsive to the trigger signal and operative, after a predetermined selected time delay provided by the delay circuit, to generate a switching signal, said time delay being adapted to be at least substantially the duration of the light impulse; and switching means responsive to the switching signal and adapted to activate the associated flash unit.

10. The device as claimed in claim 9 including a capacitor for powering the circuit, the trigger signal permitting power from the capacitor to discharge through the delay circuit, and such discharge powering the delay circuit to transmit the switching signal after the predetermined time delay.

11. The device as claimed in either claim 9 or claim 10 wherein the delay circuit includes a unijunction transistor and the control means includes a variable resistance, the resistance value determining the time delay of the time delay circuit.

12. The device as claimed in claim 10 wherein the delay circuit includes a capacitor and a zener diode, such capacitor being charged by the capacitor for the circuit and the diode ensuring a regulated voltage for the supply from the delay circuit capacitor across the delay circuit.

13. The device as claimed in claim 12 wherein the delay circuit includes a unijunction transistor and the control means includes a variable resistance, the resistance value determining the time delay of the time delay circuit.

14. A device for activating an automatic electronic slave flash unit including in a circuit light sensing means adapted to be responsive to a light impulse from a master flash and thereby generate a signal;

delay circuit means including means selectively switchable into circuit for providing different predetermined time delays, and means being responsive to the trigger signal and operative, after a selected predetermined time delay in the range between substantially one millisecond and eight milliseconds as provided by the delay circuit, to generate a switching signal; and switching means responsive to the switching signal and adapted to activate the associated flash unit.

15. A device for activating an electronic slave flash unit having a circuit including a photodiode responsive to a light impulse to generate a signal, an amplifier for said signal, switch means and the amplifier output feeding said switch means, an energy storing capacitor powering the circuit, a delay circuit including a unijunction transistor and a bank of resistors, a chosen resistor being connected to determine the time delay of the delay circuit operation, operation of the switch means generating a trigger signal wherein energy stored in the capacitor powers the delay circuit, a thyristor, the delay circuit operation passing a switching signal to the gate of the thyristor connected across terminals for a flash unit, the signal activating the thyristor to close the circuit across the terminals and so activate a flash, a zener diode in the delay circuit regulating the voltage supply to the delay circuit thereby to ensure an accurate time delay for the delay circuit.

16. A system of operating electronic flash units with a camera, wherein slave flash units are flashed in sequence after generation of a master flash initiated by the camera, the flashes of the various slave flash units being triggered by light impulse sensors with the flash units and the flashes of each flash unit being delayed relative to each other until substantial completion of the flash from the previous flash unit by a delay circuit operative with each slave flash unit, the master flash and the time delayed flashes of the slave units occurring within the shutter open time of the camera.

17. A method of operating an electronic slave flash device including the steps of selecting a time delay for the device between the activation of the device and the initiation of a flash by the device;

sensing a light impulse to activate the device;

generating a first signal in response to sensing the light impulse;

initiating a delay circuit with such first signal;

generating a switching signal from the delay circuit after the selected time delay; and activating switching means with such switching signal to fire the flash of a flash device.

18. A method as claimed in claim 17 including the step of operating a switch with such first signal, such switch transmitting a trigger signal, and powering the delay circuit with such trigger signal.

19. A method as claimed in claim 18 including the step of obtaining the trigger signal from an energy storage capacitor powered by the flash unit.

20. The method as claimed in claim 17 wherein the selected time delay is at least substantially the duration of the light impulse.

21. For use with electronic flash units in flash photography, wherein one or more slave flash units are flashed after generation of a flash from a master flash unit initiated by a camera, at least one or more of the slave flash units or the master flash unit being automatic, a device for activating a slave flash unit including in a circuit, light sensing means adapted to be responsive to a light impulse from a master flash unit to thereby generate a first signal, delay circuit means including control means for providing different time delays, said delay circuit means being responsive to said first signal and operative, after a predetermined selected time delay to generate a switching signal, and switching means responsive to the switching signal and adapted to activate the associated slave flash unit.

22. A device as claimed in claim 21 wherein the master flash unit is automatic.

23. A device as claimed in claim 21 or 22 wherein at least one slave flash unit is automatic.

24. A device as claimed in claim 21 or 22 wherein all the slave flash units are automatic.

25. A device as claimed in claim 21 or 22 wherein the time delay is at least substantially the duration of the light impulse from the master flash.

26. A device as claimed in claim 21 wherein including more than one slave flash unit, and wherein the time delay of each slave flash unit is selectable to be at least substantially the duration of the light impulse from the master flash unit and additionally the duration of the flash from preceding slave flash units.

27. An electronic slave flash unit including in a circuit a flash unit, light sensing means adapted to be responsive to a light impulse from a master flash device to thereby generate a first signal;

delay circuit means including control means for providing different time delays, said delay circuit means being responsive to said first signal and operative, after a predetermined selected time delay, to generate a switching signal; and switching means responsive to the switching signal and adapted to activate the associated flash unit.

28. The flash unit as claimed in claim 27 wherein the flash unit is automatic, and the control means includes a bank of resistances and switch means for selecting a resistance for a requisite time delay.

29. The flash unit as claimed in claim 27 wherein the flash unit is automatic, and the control means includes a variable resistance and means for selecting a resistance value for a requisite time delay.

30. A device for activating an electronic slave flash unit including in a circuit light sensing means adapted to be responsive to a light impulse from a master flash unit to thereby generate a first signal;

delay circuit means for providing a delay duration of at least substantially the duration of the light impulse from the master flash, said delay circuit means being responsive to said first signal and operative, after a predetermined time delay, to generate a switching signal; and switching means responsive to the switching signal and adapted to activate the associated flash unit.

31. The device as claimed in claim 30 including switch means between the light sensing means and the delay circuit, the switch means being responsive to the first signal to transmit a trigger signal to the delay circuit means.

32. The device as claimed in claim 31 including an energy storage capacitor for powering the circuit, the trigger signal permitting power from the capacitor to discharge through the delay circuit, and such discharge powering the delay circuit to transmit the switching signal after a predetermined time delay.

33. The device as claimed in either claim 31 or claim 32 wherein the delay circuit includes a capacitor and a zener diode, such capacitor being charged by the capacitor for the circuit and such diode ensuring a regulated voltage supply from the delay circuit capacitor across the delay circuit.

* * * * *